US006647224B2

(12) United States Patent
Johnson et al.

(10) Patent No.: US 6,647,224 B2
(45) Date of Patent: Nov. 11, 2003

(54) OPTICAL MONITOR FOR IMAGING DEVICE FILTER

(75) Inventors: Bruce L. Johnson, Eagle, ID (US); Bradley J. Anderson, Boise, ID (US); Douglas K. Howell, Fort Collins, CO (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 7 days.

(21) Appl. No.: 10/061,737

(22) Filed: Jan. 31, 2002

(65) Prior Publication Data

US 2003/0142992 A1 Jul. 31, 2003

(51) Int. Cl.[7] ..... G03G 21/00
(52) U.S. Cl. ..... 399/93; 399/98
(58) Field of Search ..... 399/93, 98, 99

(56) References Cited

U.S. PATENT DOCUMENTS 5,999,769 A * 12/1999 Anderson et al. ..... 399/93
6,055,393 A * 4/2000 Anderson et al. ..... 399/93 X

* cited by examiner

*Primary Examiner*—William J. Royer

(57) ABSTRACT

A device for monitoring the status or condition of a filter element for an imaging device which employs an optical sensing device to monitor a concentration of toner particles. In one embodiment, the optical sensing device monitors a concentration of toner particles captured in a filter element within an electrostatic imaging device. The optical sensing device is connected to an imaging device controller. An output connected to the controller displays data representative of a degree to which the filter element is clogged by toner particulate.

20 Claims, 4 Drawing Sheets

OPTICAL MONITOR FOR IMAGING DEVICE FILTER

BACKGROUND OF THE INVENTION

1. Technical Field

The present invention relates generally to imaging devices and more particularly to a device for monitoring the condition of a toner filter assembly for an imaging device.

2. Background Art

The process of electrostatic imaging, whether in an electrophotographic copier, a laser printer, or another imaging device, typically involves the light-directed distribution of electrostatic charge over the surface of a photoconductor. A developing system deposits toner particles on the photoconductor and the toner particles are in turn deposited as an image onto a sheet of paper. In order to prolong the life of an imaging system, imaging systems typically, use replaceable assemblies including consumable elements of the imaging system such as toner and wear-sensitive elements including developing systems and photoconductors.

During the imaging process, toner particles may become airborne and deposit undesirably within the imaging system or may escape the imaging system entirely. Loose toner can create print quality problems, clog replaceable and non-replaceable moving parts within the imaging system, and contaminate the environment outside the imaging system. Attempting to clean loose toner out of an imaging device is difficult and may damage fragile parts within the imaging system. An imaging device may therefore include a filter assembly which removes toner particles from the air circulating within the imaging system. Similarly, a replaceable toner cartridge or developer assembly may also include a filter assembly which removes toner particles from the air circulating within the imaging system. A loss of toner may also occur if elements within a toner cartridge or developer assembly, such as toner seals, break. Breakage is more common when the toner within the toner cartridge or developer assembly is refilled or, if many images requiring little toner are printed, and the lifetime of the moving parts within the developer assembly expires before toner levels dwindle. This may lead to breakage of toner seals or other parts. Toner spillage due to breakage rapidly clogs the filter assembly. Over the life of a toner cartridge or developer assembly, toner can clog the filter assembly even without a breakage event. In either case, the clogging of the filter assembly may go unnoticed by the user, inadvertently degrading the performance of the imaging device.

Therefore, it may be advantageous to provide a device for monitoring the condition of imaging device air/toner filter assemblies. It may also be advantageous to prevent usage of the imaging system if the toner filter assembly is clogged. There may also be an advantage in providing for a qualitative estimate of filter life that may also aid in detecting toner seal leakage or breakage if filter blockage increases more quickly than normal.

SUMMARY OF THE INVENTION

The present invention is directed to a device for monitoring an air transport efficiency of an air/toner filter element for an imaging device. The device employs an optical sensing device to monitor a concentration of toner particles in the filter element. The air/toner filter element may be installed in a wall of an imaging device housing or in the alternative it may be incorporated directly in a toner cartridge or developer assembly. In a preferred embodiment, the optical sensing device monitors a concentration of toner particles captured in a filter element. The optical sensing device is connectable to an output or display for displaying data representative of an air transport efficiency of the filter element. The output may indicate that the filter element exhibits a predetermined condition, for instance that the filter element is functioning with an air transport efficiency of a measured percentage of full efficiency. According to the present invention, the optical sensing device determines filter element status by detecting the optical characteristics of the filter element. A relatively clean filter element will exhibit greater transmission of light indicating a relatively greater air transport efficiency. Conversely, a clogged filter element will be darker and more opaque due to the toner trapped within it indicating a relatively lesser air transport efficiency.

In a preferred embodiment of the invention, the optical sensing device is electrically connected to an imaging device controller. When a condition which indicates clogging of the filter element is detected by the optical sensing device, the controller may disable the imaging device to prevent inadvertent use of a defective toner cartridge assembly. Additionally, or in the alternative, the imaging device controller output may enable a signal in the form of a sensory output, i.e. a visual or audible signal. Alternately, the imaging device output from the controller may be in the form of a message displayed on a video output device of an attached or networked computer. This obviates the need for the user to inspect or monitor the optical sensing device directly.

In one embodiment of the invention, the optical sensing device includes an optical element which measures the amount of light that can pass through the filter element, determining its translucency. In another embodiment of the invention, the optical element measures the reflectivity, or lightness and darkness, of the filter element surface. An optical element senses the degree of blockage of the filter element as a function of the amount of light being sensed by the optical element. Alternatively, the optical sensing device may simply sense and determine a binary pass/no-pass determination, once again, as a function of the amount of light being sensed by the optical element.

An optical sensing device may operate based on a change in reflectance of light from a source to a receptor. For sensor applications, photodetector arrays require the objects they sense to be illuminated by some means. An illumination source is directed at an object, in this case the filter element, and the optical sensing device is positioned relative to the illumination source and the filter element to permit sensing of either the amount of light that passes through the filter element or, in the alternative, the sensing device senses reflectivity of an illuminated surface of the filter element. The optical element may sense both the level and the rate of filter element blockage. If the filter element begins to plug quickly, it can be assumed that excessive toner is leaking from the cartridge through the seals and the imaging device may be disabled before excessive toner is released into the printer imaging device.

The present invention consists of the parts hereinafter more fully described, illustrated in the accompanying drawings and more particularly pointed out in the appended claims, it being understood that changes may be made in the form, size, proportions and minor details of construction without departing from the spirit or sacrificing any of the advantages of the invention.

DETAILED DESCRIPTION OF THE INVENTION

Figure 1:
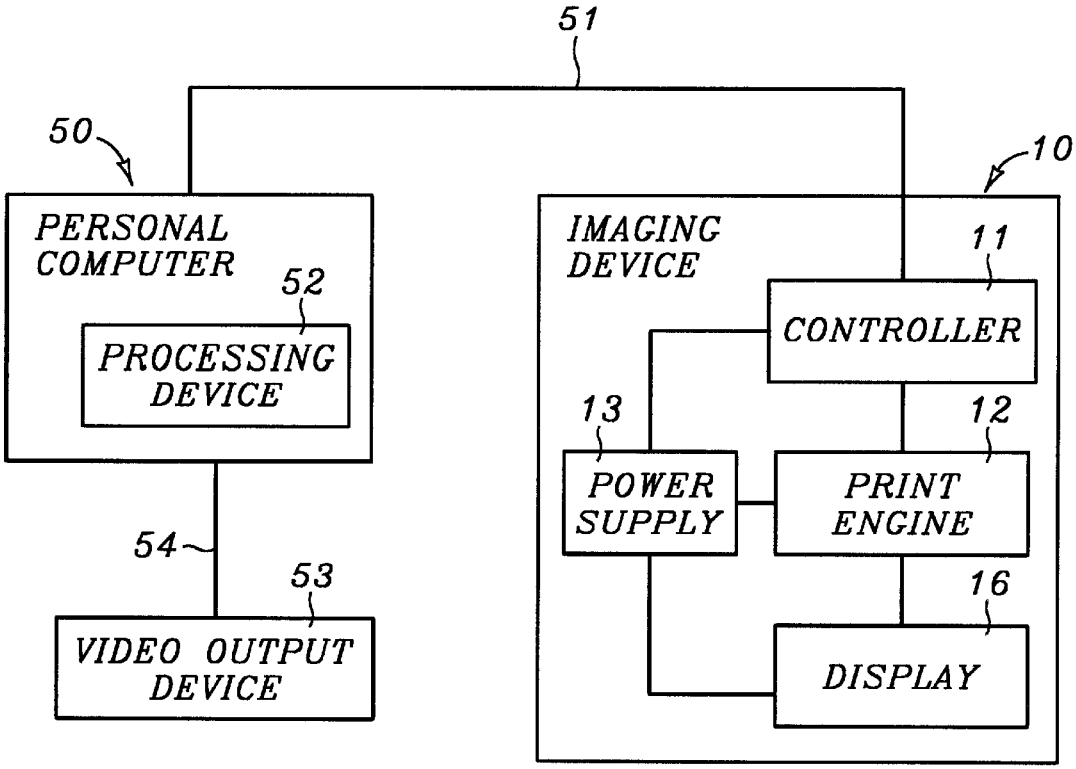
FIG. 1 is a schematic representational diagram of an electrophotographic imaging device connected to a personal computing device.

An imaging device 10 is shown in FIG. 1, connected to a personal computer 50. The personal computer 50 is connected to imaging device 10 through a cable 51. The imaging device 10 includes a controller 11 which controls various operating functions of imaging device 10 including a print engine 12. A power supply 13 provides DC electrical current to various components of imaging device 10. A display 16 provides a visual signaling device for displaying information relating to the function and status of various components of imaging device 10. The personal computer 50 includes a processing device 52. A video output device 53 is connected to personal computer 50 by a cable 54. It should be noted that the connection between personal computer 50 and imaging device 10 and personal computer 50 and video output device 53 is not limited to parallel connection and could just as well be through a serial cable connection, network connection, a remote connection via a telecommunication link, an infrared link, a radio frequency link, or the like.

Figure 2:
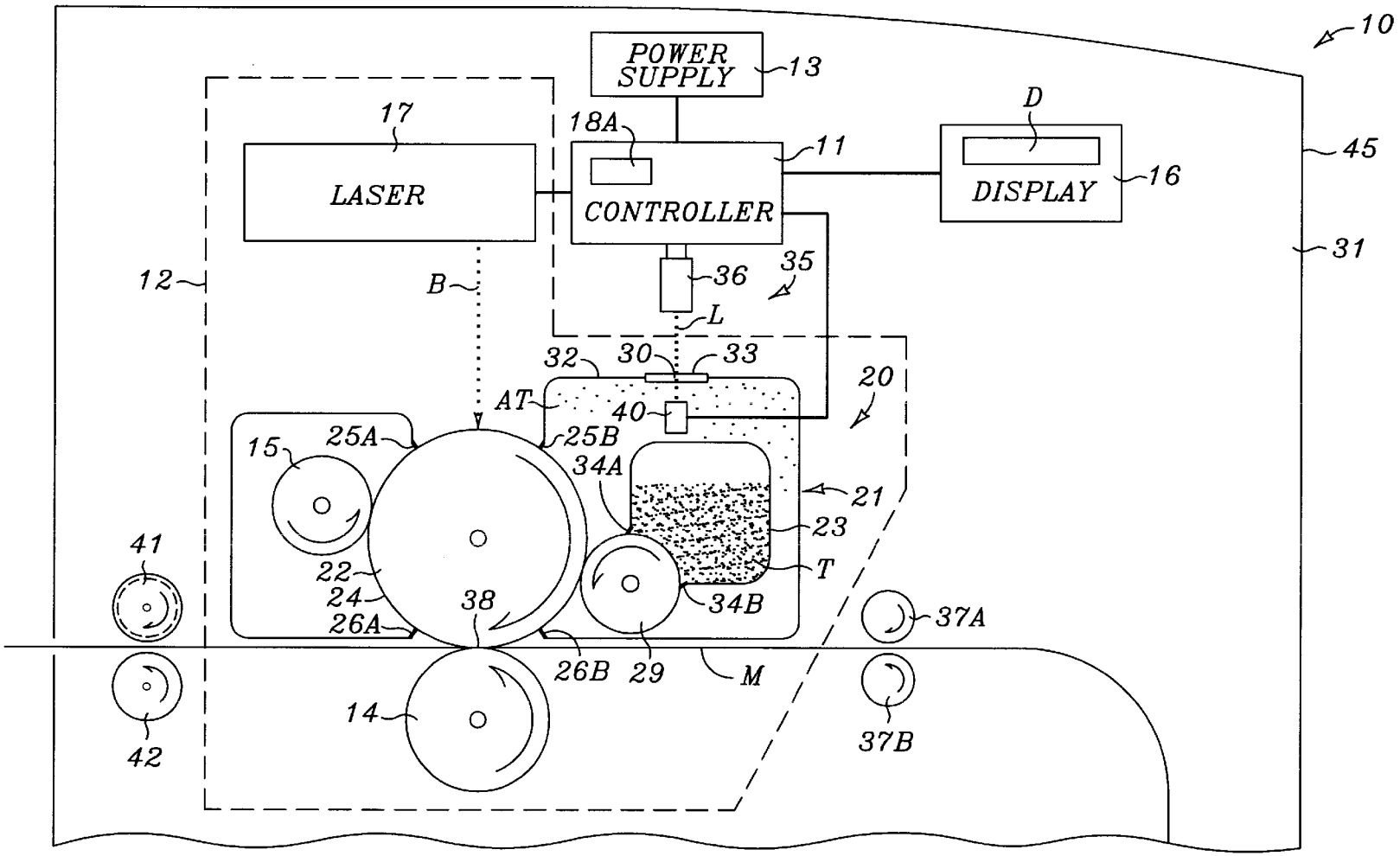
FIG. 2 is a representational schematic cutaway view of an electrophotographic imaging device including a developer assembly and a device for monitoring a developer assembly filter element.
Figure 3:
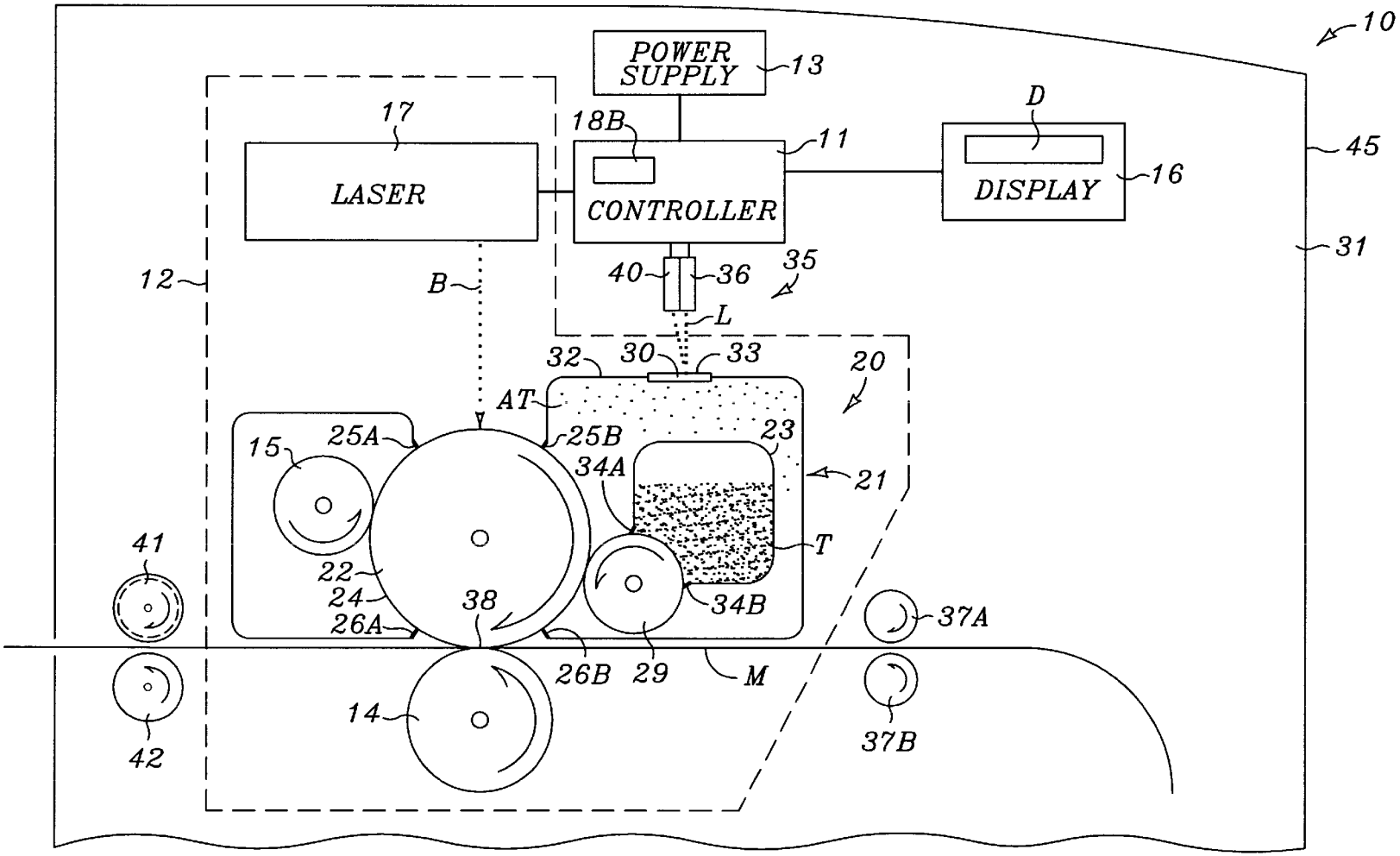
FIG. 3 is a representational schematic cutaway view of an electrophotographic imaging device including a developer assembly and a device for monitoring a developer assembly filter element.

Referring to FIGS. 2 and 3, imaging device 10 is enclosed within a housing 45 and includes controller 11 which controls various functions of imaging device 10. Power supply 13 provides power to imaging device 10 including controller 11. Print engine 12 comprises in part laser 17, producing laser beam B, developer assembly 20, transfer drum 14 and charging roller 15. The laser 17 emits laser beam B as a scanning sequence of impulses which correspond to processed information input to imaging device 10. Laser beam B is directed at toner cartridge drum 22.

As shown in FIGS. 2 and 3, developer assembly 20 includes housing 21 enclosing toner cartridge drum 22 and toner reservoir 23. Developing drum 29 transfers toner T to surface 24 of toner cartridge drum 22. Media M is transported through imaging device 10 by transport rollers 37A and 37B. Toner T is transferred to media M at nip 38 located between transfer drum 14 and toner cartridge drum 22. Toner T is fused to media M between fuser roller 41 and pressure roller 42. Primary seals 34A and 34B inhibit passage of toner T past developing drum 29. Seals 25A and 25B and 26A and 26B inhibit the passage of airborne toner AT at the interface with toner cartridge drum 22. Charging roller 15 provides an electromotive potential to surface 24 of toner cartridge drum 22.

A filter element 30 is installed in outer wall 32 of housing 21. Air may transfer from internal chamber 31 of developer assembly 20 either under ambient air pressure or under a pressure differential. Airborne toner AT is removed from air passing through filter element 30.

A filter monitoring device 35 includes illumination source 36 which is connected to controller 11 and directed at surface 33 of filter element 30. Filter monitoring device 35 also includes optical sensor 40 shown connected to controller 11. Data D representative of a condition of filter element 30 may be displayed at imaging device display 16.

FIG. 2 shows optical sensor 40 located in housing 21 and connected to controller 11. Illumination source 36 is connected to controller 11 and directed at surface 33 and optical sensor 40 through filter element 30. Controller 11 includes algorithm 18A for determining the condition of filter element 30 as a function of the amount of light L passing through filter element 30 to optical sensor 40 and generating data D representative of a condition of filter element 30 for display at imaging device display 16.

FIG. 3 shows both illumination source 36 and optical sensor 40 located external to housing 21. FIG. 3 also shows illumination source 36 and optical sensor 40 configured as an integral unit. Illumination source 36 is connected to controller 11 and directed at surface 33 of filter element 30. Optical sensor 40 senses light reflected from surface 33 of filter element 30. Controller 11 includes algorithm 18B for determining the condition of filter element 30 as a function of the amount of light L passing through filter element 30 to optical sensor 40 and generating data D representative of a condition of filter element 30 for display at imaging device display 16.

Figure 4:
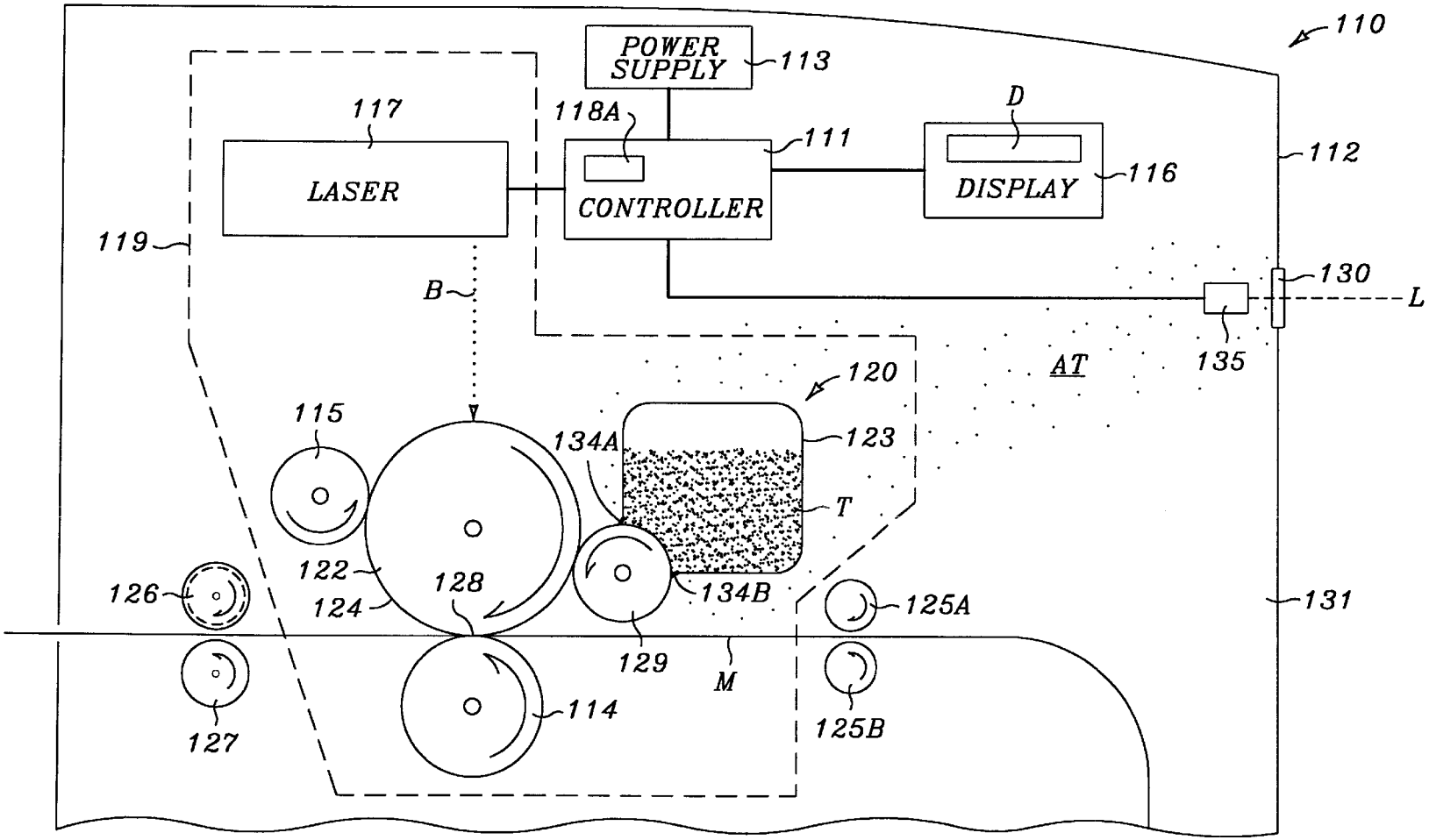
FIG. 4 is a representational schematic cutaway view of an electrophotographic imaging device including a toner cartridge assembly and a device for monitoring a filter element.

Referring to FIG. 4, imaging device 110 includes controller 111 enclosed within housing 112. Controller 111 controls various functions of imaging device 110 including print engine 119. Power supply 113 provides power to imaging device 110 including controller 111. Imaging device 110 comprises in part laser 117, producing laser beam B as a scanning sequence of impulses which correspond to processed information input to imaging device 110. Laser beam B is directed at surface 124 of photoconductor 122. Imaging device 110 also includes transfer drum 114 and charging roller 115.

As shown in FIG. 4, imaging device 110 includes toner cartridge assembly 120 including housing 123 and developing drum 129. Developing drum 129 transfers toner T to surface 124 of photoconductor 122. Media M is transported through imaging device 110 by transport rollers 125A and 125B. Toner T is transferred to media M at nip 128 located between transfer drum 114 and photoconductor 122. Toner T is fused to media M between fuser roller 126 and pressure roller 127. Primary seals 134A and 134B inhibit passage of toner T past developing drum 129. Charging roller 115 provides an electromotive potential to surface 124 of photoconductor 122.

Filter element 130 is shown installed in housing 112 of imaging device 110. Air transfers from internal chamber 131 of imaging device 110 either under ambient air pressure or under a pressure differential. Airborne toner AT is removed from air passing through filter element 130. An optical sensor 135 is connected to controller 111. Optical sensor 135 senses ambient light L through filter element 130. Data D representative of a condition of filter element 130 may be displayed at imaging device display 116. Controller 111 includes algorithm 118A for determining the condition of filter element 130 as a function of the amount of ambient light L passing through filter element 130 to optical sensor 135.

While this invention has been described with reference to the detailed embodiments, this is not meant to be construed in a limiting sense. Various modifications to the described embodiments as well as the inclusion or exclusion of additional embodiments will be apparent to persons skilled in the art upon reference to this description. It is therefore contemplated that the appended claims will cover any such modifications or embodiments as fall within the true scope of the invention.

What is claimed is:

1. A device for monitoring a filter element of an imaging device comprising:

an illumination source directed at a surface of the filter element;

an optical sensor fixed in relationship to the filter element, the optical sensor positioned to sense light from the illumination source; and an output device connected to the optical sensor for displaying data representative of an air transport efficiency of the filter element.

2. The device for monitoring a filter element of claim 1 wherein the illumination source further comprises an ambient light source.

3. The device for monitoring a filter element of claim 1 wherein the illumination source further comprises a light source connected to a power source and directed at the surface of the filter element and the optical sensor senses light from the illumination source reflected from the surface of the filter element.

4. The device for monitoring a filter element of claim 1 wherein the illumination source further comprises a light source connected to a power source and directed at the surface of the filter element and the optical sensor senses light from the illumination source at the surface of the filter element transmitted through the filter element.

5. The device for monitoring a filter element of claim 1 wherein the optical sensor further comprises an optical element positioned opposite the illumination source for measuring an amount of light passing through the filter element.

6. The device for monitoring a filter element of claim 1 wherein the optical sensor further comprises an optical element positioned to sense a reflection of the illumination source from the surface of the filter element for measuring a reflectivity of light impinging on the surface of the filter element.

7. A toner cartridge assembly comprising:

a housing;

a toner reservoir disposed within the housing for storing a toner;

a toner cartridge assembly filter element located in a wall of the housing for filtering toner particulate from ambient air passing from an interior portion of the housing; and a device for monitoring an air transport efficiency of the toner cartridge assembly filter element including an illumination source directed at a surface of the toner cartridge assembly filter element, and an optical sensor fixed in relationship to the toner cartridge assembly filter element and the illumination source, the optical sensor positioned to sense light from the illumination source and an output device connectable to the optical sensor for displaying data representative of an air transport efficiency of the toner cartridge assembly filter element.

8. The toner cartridge assembly of claim 7 wherein the illumination source further comprises an ambient light source directed at a the surface of the toner cartridge assembly filter element.

9. The toner cartridge assembly of claim 7 wherein the illumination source further comprises a light source connected to a power source and directed at the surface of the filter element and the optical sensor senses light from the illumination source reflected from the surface of the filter element.

10. The toner cartridge assembly of claim 7 wherein the illumination source further comprises a light source connected to a power source and directed at the surface of the filter element and the optical sensor senses light from the illumination source at the surface of the filter element transmitted through the filter element.

11. The toner cartridge assembly of claim 7 wherein the optical sensor further comprises an optical element positioned opposite the illumination source for measuring an amount of light passing through the toner cartridge assembly filter element.

12. The toner cartridge assembly of claim 7 wherein the optical sensor further comprises an optical element positioned to sense a reflection of the illumination source from the surface of the toner cartridge assembly filter element for measuring a reflectivity of light impinging on the surface of the toner cartridge assembly filter element.

13. An imaging device comprising:

a housing;

a controller located within the housing configured to receive an input transmission of electronic data representing an image to be printed;

a print engine including a developer assembly including a photoconductor connected to the controller for printing the image;

a power source connected to the controller;

a toner cartridge assembly removably mounted to the imaging device, the toner cartridge assembly including a toner reservoir for storing a toner for transfer to a surface of the photoconductor;

a filter element disposed in the housing for filtering toner particulate from ambient air passing from an interior portion of the housing;

a device for monitoring an air transport efficiency of the filter element including an illumination source directed at a surface of the filter element, and an optical sensor fixed in relationship to the filter element and the illumination source, the optical sensor positioned to sense light from the illumination source; and an output connectable to the optical sensor for displaying data representative of an air transport efficiency of the filter element.

14. The imaging device of claim 13 wherein the illumination source further comprises an ambient light source.

15. The imaging device of claim 13 wherein the illumination source further comprises the illumination source connected to the power source and directed at the surface of the filter element and the optical sensor senses light from the illumination source reflected from the surface of the filter element.

16. The imaging device of claim 13 wherein the illumination source further comprises the illumination source connected to a power source and directed at the surface of the filter element and the optical sensor senses light from the illumination source at the surface of the filter element transmitted through the filter element.

17. The imaging device of claim 13 wherein the optical sensor further comprises an optical element positioned opposite the illumination source for measuring an amount of light passing through the filter element.

18. The imaging device of claim 13 wherein the optical sensor further comprises an optical element positioned to sense a reflection of the illumination source from the surface of the filter element for measuring a reflectivity of light impinging on the surface of the filter element.

19. The imaging device of claim 13 wherein the output further comprises an imaging device display connected to the controller.

20. A developer assembly comprising:

a housing;

a photoconductor disposed within the housing;

a toner reservoir disposed within the housing for storing a toner for transfer to a surface of the photoconductor;

a toner cartridge assembly filter element disposed in a wall of the housing for filtering toner particulate from ambient air passing from an interior portion of the housing; and a device for monitoring an air transport efficiency of the filter element including an illumination source directed at a surface of the filter element, and an optical sensor fixed in relationship to the toner cartridge assembly filter element and the illumination source, the optical sensor positioned to sense light from the illumination source; and an output device connectable to the optical sensor for displaying data representative of an air transport efficiency of the filter element.

* * * * *